US007090126B2

(12) United States Patent
Kelly et al.

(10) Patent No.: US 7,090,126 B2
(45) Date of Patent: Aug. 15, 2006

(54) METHOD AND APPARATUS FOR PROVIDING HEIGHTENED AIRPORT SECURITY

(75) Inventors: Patrick J. Kelly, Ewa Beach, HI (US); George H. Benskin, III, Kanacha, HI (US)

(73) Assignee: Maximus, Inc., Reston, VA (US)

( * ) Notice: Subject to any disclaimer, the term of this patent is extended or adjusted under 35 U.S.C. 154(b) by 0 days.

(21) Appl. No.: 10/267,586

(22) Filed: Oct. 10, 2002

(65) Prior Publication Data

US 2003/0127511 A1 Jul. 10, 2003

Related U.S. Application Data

(60) Provisional application No. 60/330,458, filed on Oct. 22, 2001.

(51) Int. Cl.
*G07B 15/02* (2006.01)

(52) U.S. Cl. ..... 235/384; 235/375; 235/492

(58) Field of Classification Search ..... 235/380, 235/384, 375, 492
See application file for complete search history.

(56) References Cited

U.S. PATENT DOCUMENTS

| | | | | |
|---|---|---|---|---|
| 4,821,118 | A * | 4/1989 | Lafreniere | 348/156 |
| 4,993,068 | A | 2/1991 | Piosenka et al. | 380/23 |
| 5,317,309 | A | 5/1994 | Vercellotti et al. | |
| 5,920,053 | A * | 7/1999 | DeBrouse | 235/375 |
| 5,982,281 | A | 11/1999 | Layson, Jr. | |
| 5,987,155 | A | 11/1999 | Dunn et al. | 382/116 |
| 6,085,976 | A | 7/2000 | Sehr | |
| 6,119,096 | A | 9/2000 | Mann et al. | |
| 6,127,917 | A | 10/2000 | Tuttle | |
| 6,158,658 | A | 12/2000 | Barclay | 235/384 |
| 6,219,439 | B1 * | 4/2001 | Burger | 382/115 |
| 6,229,445 | B1 * | 5/2001 | Wack | 340/572.7 |
| 6,335,688 | B1 * | 1/2002 | Sweatte | 340/573.1 |
| 6,394,343 | B1 * | 5/2002 | Berg et al. | 235/379 |
| 6,494,369 | B1 * | 12/2002 | Kikuchi | 235/384 |
| 6,594,547 | B1 * | 7/2003 | Manabe et al. | 700/227 |

FOREIGN PATENT DOCUMENTS

| | | |
|---|---|---|
| WO | WO 9606409 A1 | 2/1996 |
| WO | WO 02/29744 A1 | 4/2002 |
| WO | WO 0227686 A1 | 4/2002 |

OTHER PUBLICATIONS

International Search Report, PCT/US 02/33484, dated Nov. 14, 2003 (8 pages).

* cited by examiner

*Primary Examiner*—Seung H Lee
(74) *Attorney, Agent, or Firm*—Finnegan, Henderson, Farabow, Garrett & Dunner, LLP

(57) ABSTRACT

A method for providing passenger accountability for airports and other mass transit facilities is disclosed. In operation, a check-in agent receives information identifying a passenger seeking to board a commercial carrier. The passenger is designated as checked-in, and then the present system may use a frequent flyer card or a boarding pass to monitor a location of the checked-in passenger prior to boarding the commercial carrier.

20 Claims, 10 Drawing Sheets

DATABASE AND SMART CARD INFORMATION

DATABASE CAPTURE
(INFORMATION WRITTEN TO THE DATABASE AT AIRPORT CHECK IN COUNTER)

- LAST NAME 405
- FIRST NAME 410
- MIDDLE INTITIAL 415
- GENDER 420
- ADDRESS 425
- PHONE NUMBER 430
- PREFERENCES 435
- FORM OF IDENTIFICATION 440
- IDENTIFICATION NUMBER 445
- FACIAL RECOGNITION BIOMETRIC 465
- FINGERPRINT BIOMETRIC 450
- NEXT OF KIN 455
- CHECKED BAGGAGE BAR CODES 460
- FLIGHT NUMBER 470
- SEAT ASSIGNMENT 475
- TIMESTAMPS 480
  - AIRPORT CHECK IN COUNTER
  - PASSENGER HOLDING CHECK IN
  - PASSENGER HOLDING AREA LEFT
  - PASSENGER AIRCRAFT BOARDING

SMART CARD CAPTURE
(INFORMATION WRITTEN TO THE SMART CARD AT CARD ISSUANCE OR AT THE AIRPORT CHECK IN COUNTER)

- LAST NAME 405
- FIRST NAME 410
- MIDDLE INTITIAL 415
- GENDER 420
- ADDRESS 425
- PHONE NUMBER 430
- PREFERENCES 435
- FORM OF IDENTIFICATION 440
- IDENTIFICATION NUMBER 445
- FINGERPRINT BIOMETRIC 450
- NEXT OF KIN 455
- CHECKED BAGGAGE BAR CODES 460

FIG. 6

METHOD AND APPARATUS FOR PROVIDING HEIGHTENED AIRPORT SECURITY

CROSS-REFERENCE TO RELATED APPLICATIONS

This application claims the benefit of U.S. provisional application Ser. No. 60/330,458, filed Oct. 22, 2001, the disclosure of which is hereby incorporated by reference herein.

TECHNICAL FIELD

The present invention is directed to systems and methods for enhancing security in the travel industry, and more particularly to a method for enhancing commercial airline security by closely screening travelers and monitoring the movements of travelers and baggage.

BACKGROUND

Most airport security systems provide physical security through airport security patrols and monitoring, badging and security doors. Control of airport employees is included with stringent security checks prior to employment. A second layer of airline baggage security is provided using manual search, traveler questioning and matching, and an assortment of detection hardware. Historically, traveler screening has been performed by visual identification with a traveler provided picture government ID card or passport, metal detectors and carry on baggage checks. Given the ease with which these ID cards can be fraudulently made, and after the Sep. 11, 2001 terrorist acts, a more reliable means for traveler screening is required.

Examples of U.S. Patents on airport security and baggage accountability are PCT No. WO 02/29744 A1, U.S. Pat. Nos. 4,993,068 and 6,158,658. PCT publication number WO 02/29744 discloses an ingress/egress control system for airport concourses and other access controlled areas wherein a series of security portals are arranged to provide additional screening for persons suspected of carrying prohibited items. The system fails to teach or disclose an airport security system that is adapted to communicate with external databases to identify wanted criminals or other persons of interest, prior to their boarding a commercial carrier. The system also fails to disclose the capability to monitor the movements of passengers while in the airport terminal. Nor does it disclose a system capable of retrieving an immutable image (facial image or digital fingerprint) of the traveler and correlating that image to the traveler's baggage.

U.S. Pat. No. 6,158,658 discloses a system and method for matching passengers and their baggage. One embodiment of the invention includes a reader for scanning the passenger's boarding pass before the passenger is permitted to board the commercial carrier. The system then compares the boarded passengers' passenger identifiers to the passenger identifiers generated at check-in to identify passengers who checked baggage but failed to board the commercial carrier. Having these passenger identifiers enables a baggage handler to find the positive passenger bag matching identifiers corresponding to the unboarded passengers. From the positive passenger bag matching identifiers, the baggage handler may recover the image of the unboarded passenger's baggage, thereby allowing the checked baggage to be located visually and removed from the commercial carrier. The system fails to teach or disclose an airport security system that is adapted to communicate with external databases to identify wanted criminals or other persons of interest, prior to their boarding a commercial carrier. The system also fails to disclose the capability to monitor the movements of passengers while in the airport terminal. Nor does it disclose a system capable of retrieving an immutable image (facial image or digital fingerprint) of the traveler and correlating that image to the traveler's baggage.

U.S. Pat. No. 4,993,068 discloses an unforgeable personal identification system. One embodiment of the identification system includes an apparatus for generating encrypted physically immutable identification credentials of a user that are stored on a portable memory device. A remote access control site first reads the encrypted identification credentials from the portable memory device. Next, the user has his actual physical characteristics input to the access control site via a physical trait input device. Lastly, the identification credentials input directly from the user and those input via the portable memory device are compared. If the comparison is successful, the requested access is granted to the user. Otherwise, the requested access is denied by the remote access control site. The system fails to teach or disclose an airport security system that is adapted to communicate with external databases to identify wanted criminals or other persons of interest, prior to their boarding a commercial carrier. The system also fails to disclose the capability to monitor the movements of passengers while in the airport terminal.

What is therefore desired is an airport security system that is adapted to communicate with external databases to identify wanted criminals or other persons of interest, prior to their boarding a commercial carrier. It is also desirable to provide a system and method for monitoring the movements of passengers while in the airport terminal.

SUMMARY OF THE INVENTION

In accordance with the present invention, a method for providing passenger accountability for airports and other mass transit facilities is disclosed. In operation, a check-in agent receives information identifying a passenger seeking to board a commercial carrier. The passenger is designated as checked-in, and then the present system may use a frequent flyer card or a boarding pass to monitor a location of the checked-in passenger in the terminal prior to boarding the commercial carrier.

Additional objects and advantages of the invention will be set forth in part in the description that follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary only and not restrictive of the invention as claimed.

BRIEF DESCRIPTION OF THE DRAWINGS

The invention will be described with reference to the following drawings in which like reference numerals refer to like elements and wherein:

FIG. 6 is a listing of the data items stored on a frequent flyer smart card and a smart card boarding pass in accordance with one embodiment of the present invention;

DETAILED DESCRIPTION

Figure 1:
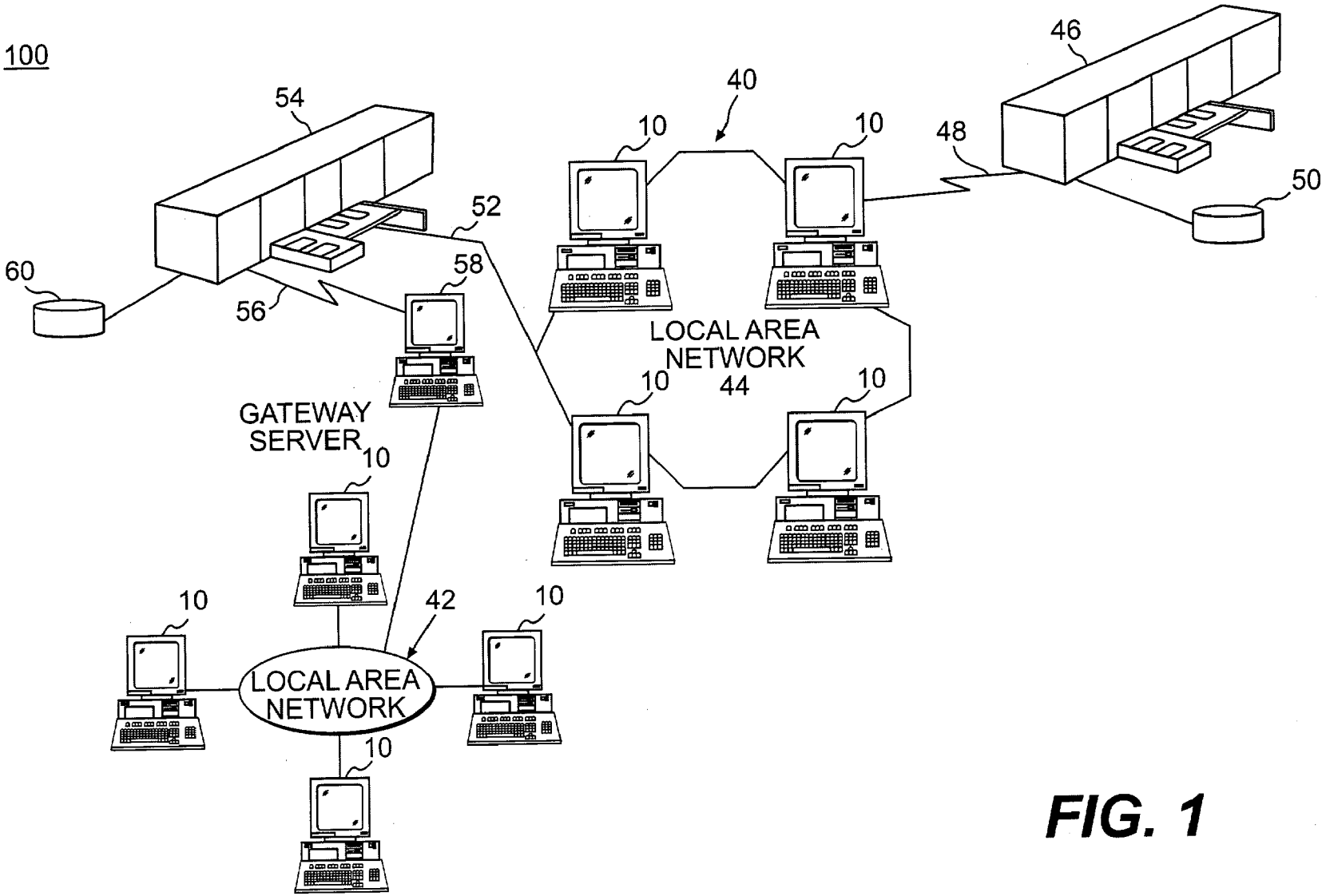
FIG. 1 depicts a data processing network in which the present invention may be practiced.

In the following detailed description, reference is made to the accompanying drawings that form a part thereof, and in which is shown by way of illustration a specific embodiment in which the invention may be practiced. This embodiment is described in sufficient detail to enable those skilled in the art to practice the invention and it is to be understood that other embodiments may be utilized and that algorithmic changes may be made without departing from the scope of the present invention. The following detailed description is, therefore, not to be taken in a limited sense.

Turning first to the nomenclature of the specification, the detailed description which follows is represented largely in terms of processes and symbolic representations of operations performed by conventional computer components, including a central processing unit (CPU), memory storage devices for the CPU, and connected pixel-oriented display devices. These operations include the manipulation of data bits by the CPU, and the maintenance of these bits within data structures reside in one or more of the memory storage devices. Such data structures impose a physical organization upon the collection of data bits stored within computer memory and represent specific electrical or magnetic elements. These symbolic representations are the means used by those skilled in the art of computer programming and computer construction to most effectively convey teachings and discoveries to others skilled in the art.

For the purposes of this discussion, a process is generally conceived to be a sequence of computer-executed steps leading to a desired result. These steps generally require physical manipulations of physical quantities. Usually, though not necessarily, these quantities take the form of electrical, magnetic, or optical signals capable of being stored, transferred, combined, compared, or otherwise manipulated. It is conventional for those skilled in the art to refer to these signals as bits, values, elements, symbols, characters, terms, objects, numbers, records, files or the like. It should be kept in mind, however, that these and similar terms should be associated with appropriate physical quantities for computer operations, and that these terms are merely conventional labels applied to physical quantities that exist within and during operation of the computer.

It should also be understood that manipulations within the computer are often referred to in terms such as adding, comparing, moving, etc., which are often associated with manual operations performed by a human operator. It must be understood that no such involvement of a human operator is necessary or even desirable in the present invention. The operations described herein are machine operations performed in conjunction with a human operator or user who interacts with the computer. The machines used for performing the operation of the present invention include general purpose digital computers or other similar computing devices.

In addition, it should be understood that the programs, processes, methods, etc. described herein are not related or limited to any particular computer or apparatus. Rather, various types of general purpose machines may be used with programs constructed in accordance with the teachings described herein. Similarly, it may prove advantageous to construct specialized apparatus to perform the method steps described herein by way of dedicated computer systems with hard-wired logic or programs stored in nonvolatile memory, such as read only memory.

The operating environment in which the present invention is used encompasses general distributed computing systems wherein general purpose computers, work stations, or personal computers are connected via communication links of various types. In a client server arrangement, programs and data, many in the form of objects, are made available by various members of the system.

Referring now to the drawings, in which like numerals represent like elements throughout the several figures, the present invention will be described.

FIG. 1 depicts a data processing network 100 in which the present invention may be practiced. The data processing network 100 includes a plurality of individual networks, including LANs 42 and 44, each of which includes a plurality of individual workstations 10. Alternatively, as those skilled in the art will appreciate, a LAN may comprise a plurality of intelligent workstations coupled to a host processor. LAN 44 may be directly coupled to another LAN (not shown), a mainframe 54 or a gateway server 58. Gateway server 58 is preferably an individual computer or intelligent workstation that serves to indirectly link LAN 42 to LAN 44. Data processing network 100 may also include multiple servers in addition to server 58. Mainframe computers 46 and 54 may be preferably coupled to the LAN 44 and LAN 42 by communications links 48, 52 and 56, respectively. Mainframe computers 46 and 54 may also be coupled to storage devices 50 and 60, respectively, which may serve as remote storage for LANs 44 and 42, respectively. In one embodiment, storage devices 50 and 60 may store a plurality of personnel and criminal records. Those skilled in the art will appreciate that the server 58 may be located a great geographic distance from the LAN 42. Similarly, the LAN 44 may be located a substantial distance from the LAN 42.

A system in accordance with the present invention, further comprises a plurality of workstations 10 and associated servers and mainframes. The servers may be generally similar to the workstations 10 including a central processing unit, display device, memory and operator input device. Moreover, it will be appreciated that workstation 10 may also perform operations described herein as being performed by a server, and similarly a server may perform operations described herein as being performed by workstation 10. The distributed system may comprise any one of a number of types of networks over which workstations and servers communicate, including LANs, wide area networks (WANs), the Internet and any other networks that distribute processing and share data among a plurality of nodes. All of these configurations, as well as the appropriate communications hardware and software, are known in the art.

Figure 2:
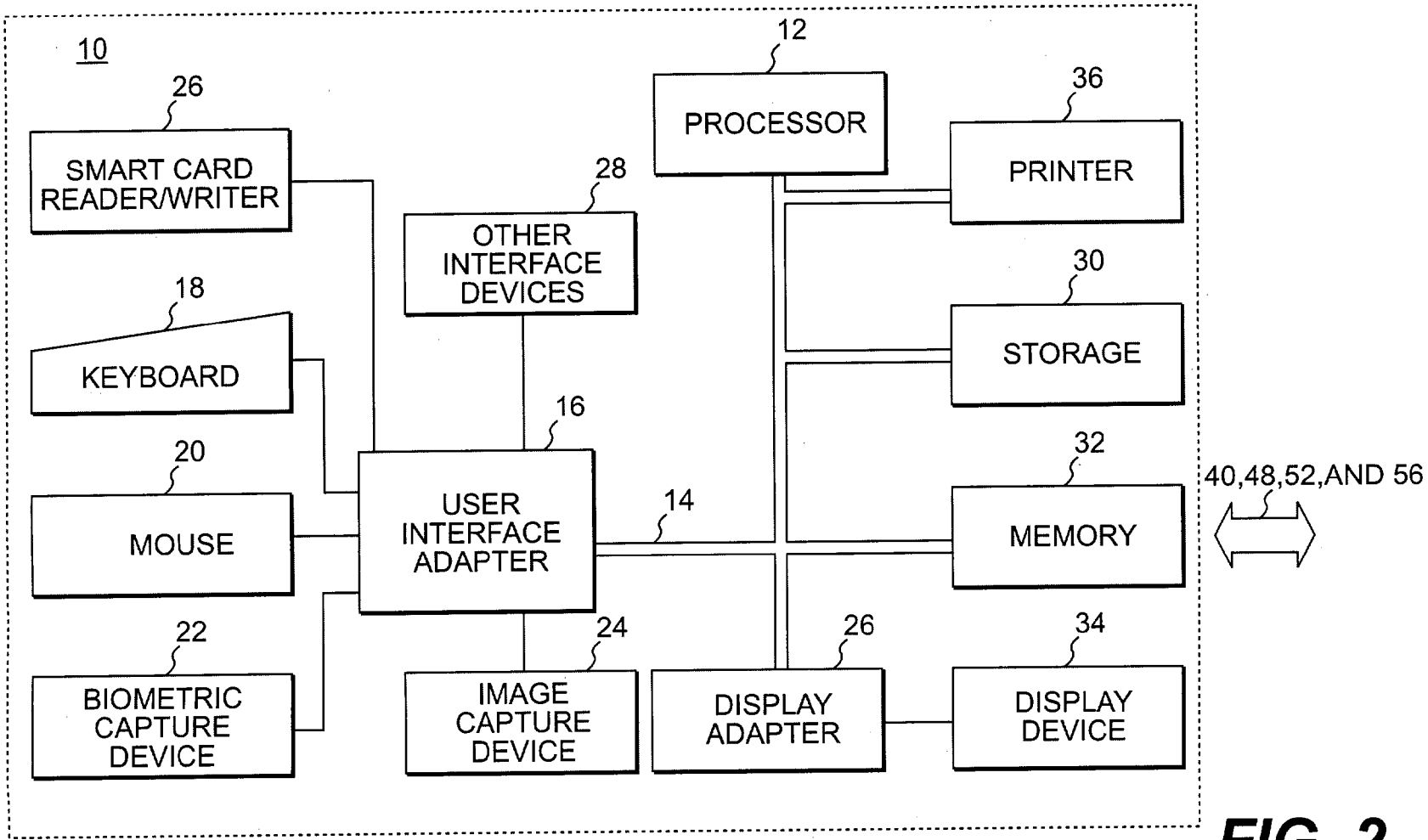
FIG. 2 is a detailed representation of a user computer workstation in accordance with one embodiment of the present invention.

FIG. 2 illustrates a detailed representation of a user computer workstation 10 as shown in FIG. 1. Workstation 10 includes a microprocessor 12 and a bus 14 employed to connect and enable communication between the microprocessor 12 and the components of the workstation 10 in accordance with known techniques. The workstation 10 typically includes a user interface adapter 16, which connects the microprocessor 12 via bus 14 to one or more interface devices, such as a keyboard 18, mouse 20, fingerprint or other biometric capture device 22, image capture device 24, smart card reader 26 and/or other interface devices 28, which may be any user interface device, such as a touch sensitive screen, digitized entry pad, etc. Bus 14 also connects a printer 36, a display device 34, such as an LCD screen or monitor, to the microprocessor 12 via a display adapter 26. Display device 34 may be provided to display data entered into workstation 10. Data, such as hard copy data, entered through a digital scanner (not shown) or photographic data taken by image capture device 24 or keyboard input via keyboard 18, may be displayed on display device 34 to verify that the correct information has been obtained via workstation 10. Printer 36 may be provided to generate a baggage claim tag bearing a baggage code and a code identifying the owner of the baggage. The bus 14 additionally connects the microprocessor 12 to memory 32 and long-term storage 30 which can include a hard drive, diskette drive, tape drive, etc. In one embodiment, memory 32 may include random access memory and/or read only memory. A plurality of communication links 40, 48, 52 and 56 may also be coupled to workstation 10 to facilitate communication with other computers on data processing network 100. Workstation 10 may further be connected via modems (not shown) to remote sites. These remote sites may store identification and criminal history data for access by users at workstations 10. Workstation 10 may further be connected to an encryption function (not shown). Information to be encrypted is sent from workstation 10 to the encryption function, and the resulting cipher text formed by the encryption function are sent back to workstation 10.

Figure 3:
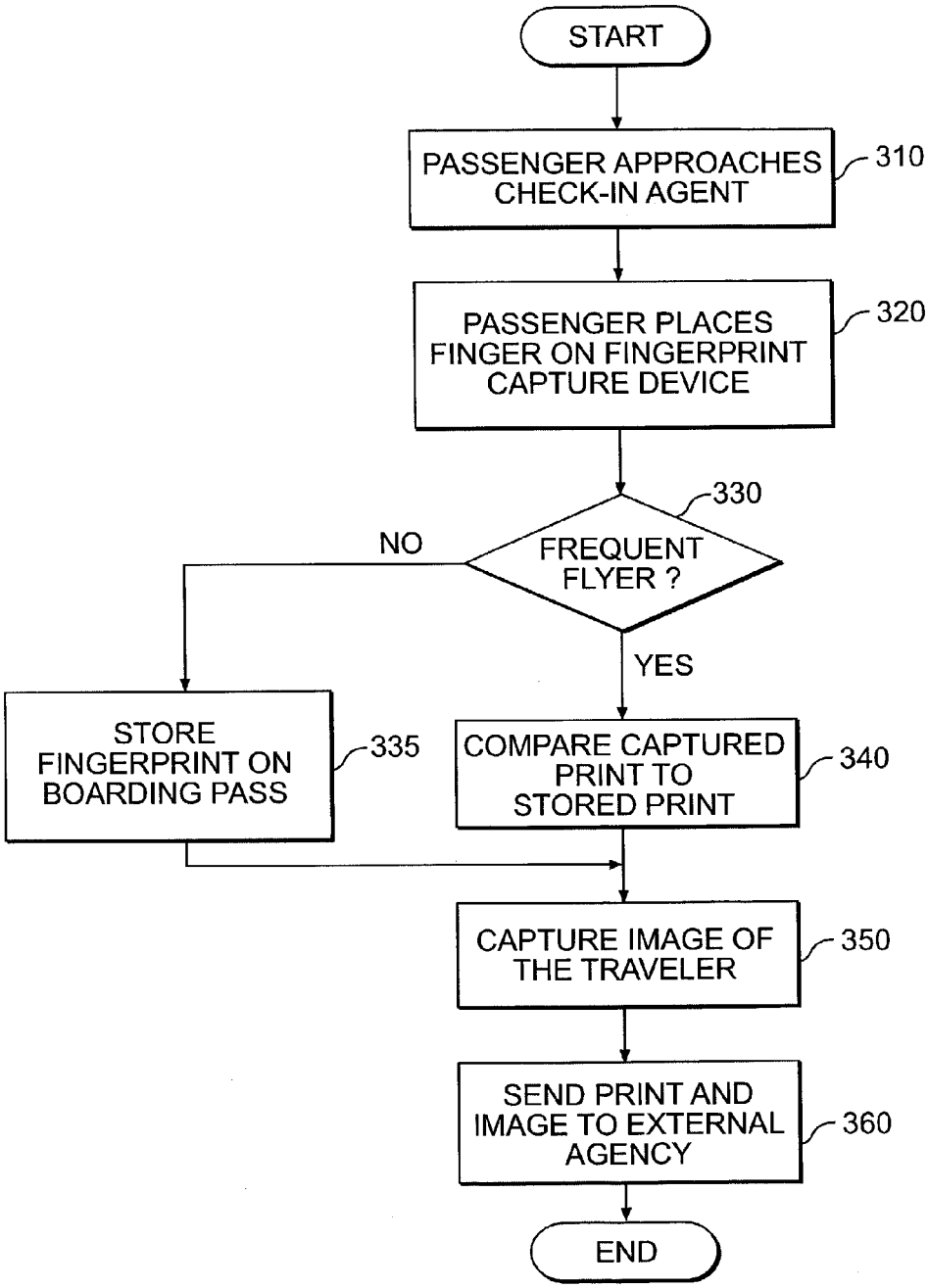
FIG. 3 is a detailed flowchart of the passenger check-in process in accordance with the present invention.
Figure 4:
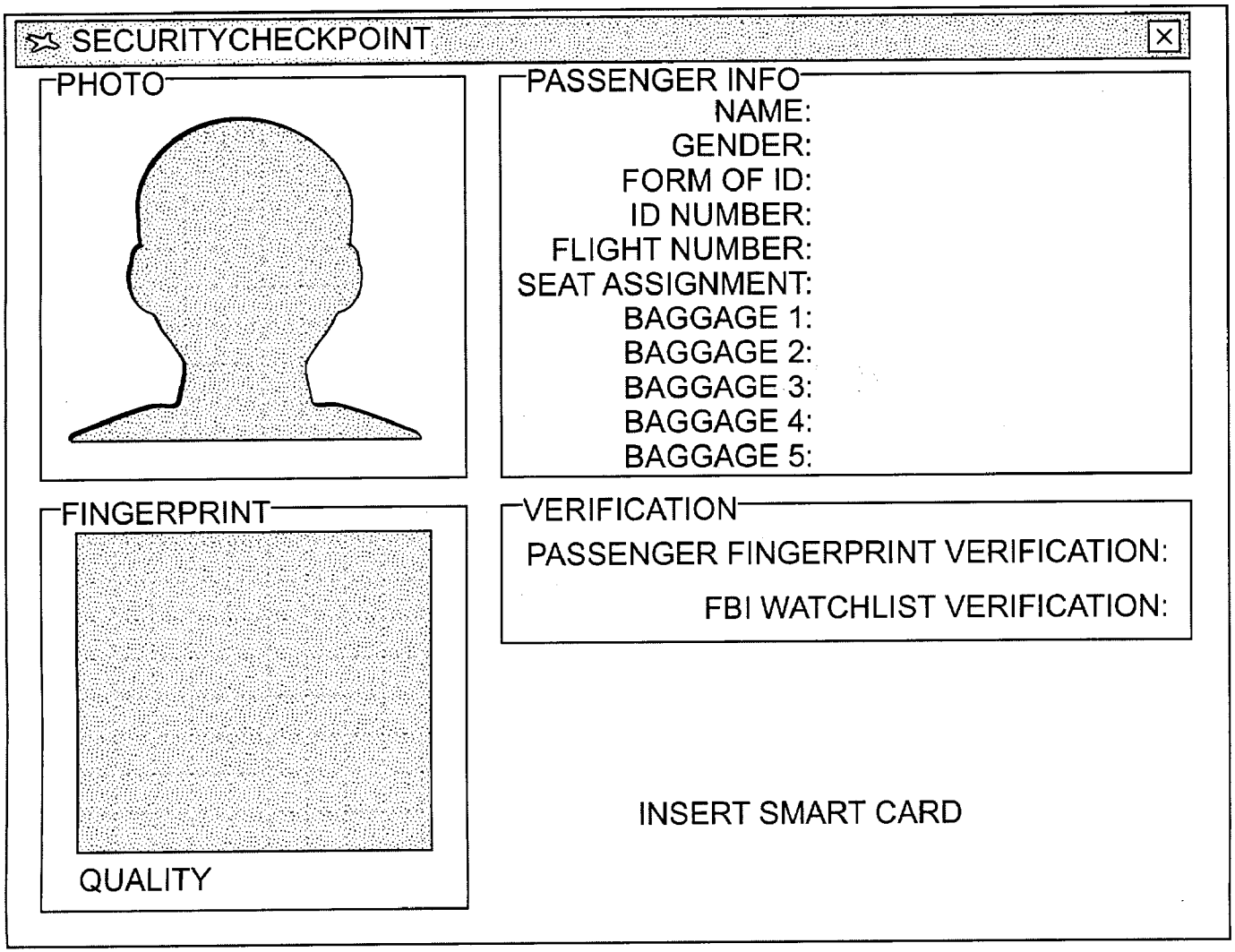
FIG. 4 is a diagrammatic depiction of a display that may be shown to a frequent flyer in accordance with the present invention.
Figure 5:
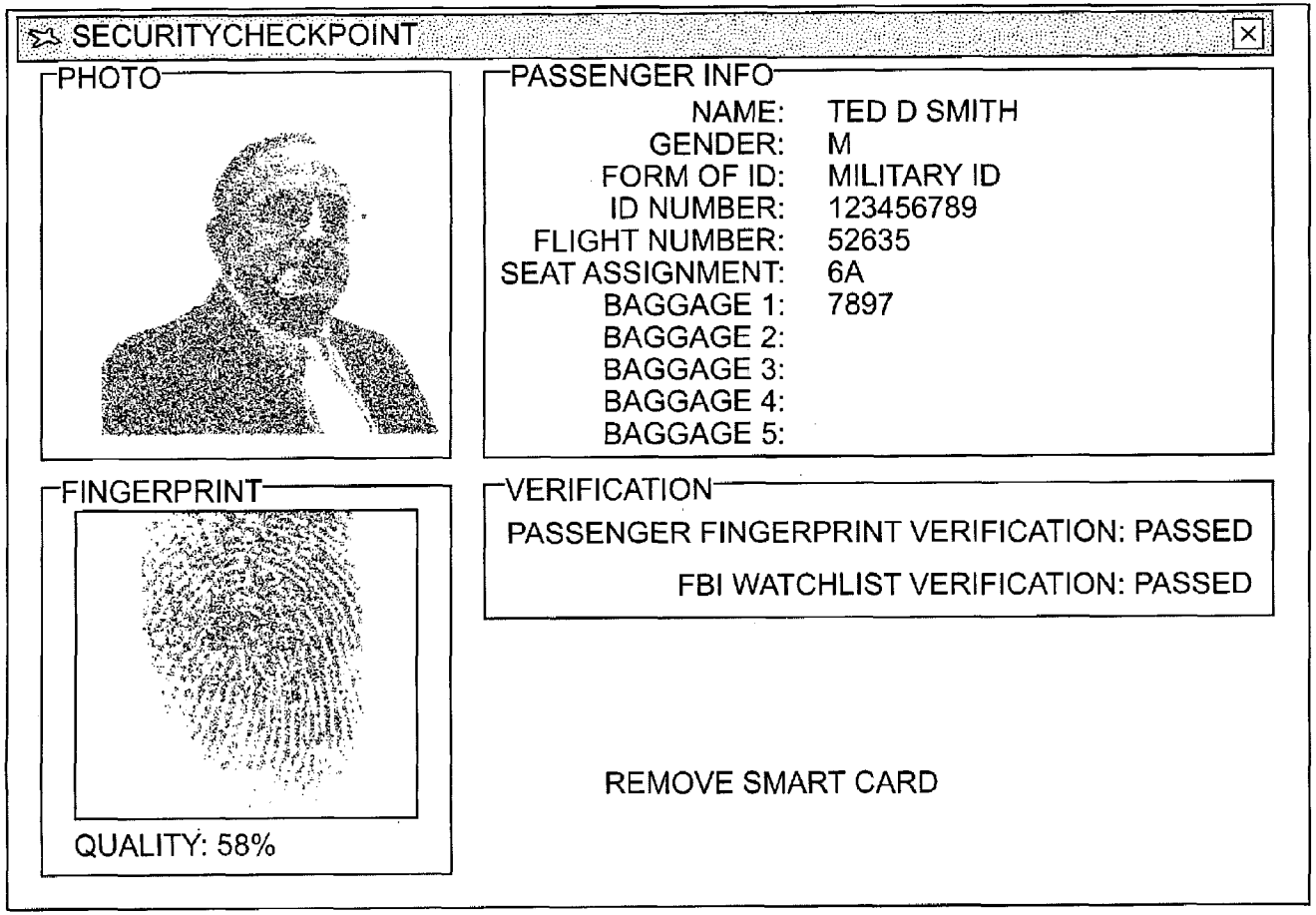
FIG. 5 is diagrammatic depiction of a display that may be shown to a check-in agent in accordance with the present invention.

Referring now to FIG. 3, there is shown a detailed flowchart of the passenger check-in process in accordance with the present invention. In one embodiment software for executing the process depicted in FIG. 3 is loaded into random access memory (not shown) for execution on microprocessor 12. As shown in FIG. 3, processing begins in step 310 when a traveler approaches a check-in agent to begin the check-in process. In one embodiment, a check-in agent located at a workstation 10 or a server 58 accesses mainframes 46 and 54 to process traveler requests. Processing next flows to step 320 where the traveler places their finger on a fingerprint capture device 22 to begin the identification process. Previously, a traveler would identify himself or herself to a check-in agent by presenting some form of identification card or passport that may have been issued by a governmental agency or entity. Given the ease with which those prior forms of identification could be forged, it is preferable that a more secure form of identification be used to reduce the possibility of accidental or fraudulent misidentification of the traveler. In the present invention, the fingerprint capture may be used in addition to, or instead of the prior identification documents. The fingerprint capture may be replaced by any other biometric collection method (e.g., retinal scan, voice analysis, etc.) without departing from the spirit and scope of the present invention. The present system then asks the user to place their frequent flyer smart card 400 into the smart card reader 26 (step 330). If the traveler places a frequent flyer smart card 400 into smart card reader 26 (i.e., the traveler is a frequent flyer), processing flows to step 340 and the inputted fingerprint is compared to a stored fingerprint on the traveler's frequent flyer smart card 400. If the inputted fingerprint is identical to the stored fingerprint, processing continues to step 350. If the captured fingerprint image is not identical to the stored fingerprint, processing terminates. An example of a screen that may be shown to the frequent flyer is depicted in FIG. 4. As shown, the frequent flyer is instructed to place his smart card into the smart card reader/writer 26 in FIG. 4. FIG. 5 depicts a typical display screen that may be shown to a check-in agent or other security personnel after a frequent flyer has inserted his smart card into smart card reader/writer 26.

If the traveler does not have a frequent flyer smart card 400 to place into smart card reader 26, or if the frequent flyer exceeds a predetermined time period for placing their frequent flyer smart card 400 into smart card reader 26, processing flows to step 335 where the check-in agent inputs the traveler's information into workstation 10. For the purposes of this discussion, a frequent flyer is a traveler who has a frequent flyer smart card 400. Travelers who do not have frequent flyer smart cards 400, will be issued a smart card boarding pass 410 at the completion of the boarding process. Once they board the aircraft or after the aircraft reaches its final destination, the smart card boarding pass would be returned to the airline.

The type of information that may be inputted into workstation 10 includes, but is not limited to the traveler's: last name, first name, middle initial, gender, address, phone number, preferences, form of the source identification (used to verify traveler's ID), identification number (from the source identification document), fingerprint biometric, next of kin, and checked baggage bar codes. Other personal information may be collected as well. Such data may include medical information about the traveler, particular privileges held by the traveler, such as organizational affiliations (e.g., company, military, etc.), security clearance levels, passport and visa information, financial information, such as bank deposits, credit limitations or cash amounts which may be debited by various commercial institutions. Once the information is collected, processing flows to step 350. In one embodiment, the collected information may be written on to a "credit card" sized card having memory by smart card reader/writer 26. Many forms of a digital storage medium are available to be used with this system. These digital storage media include the following types: magnetic card strips; electronic memory cards (RAM, PROM, EPROM and EEPROM); and optical card memories. In addition, other storage media, such as computer floppy discs may be utilized. As an alternate to storing the collected information on a hard memory medium, the information may also be sent from workstation 10, via communication link 40, 48, 52, 56, or modem to one or more remote sites. The information collected by the check-in agent may later be stored on to a smart card boarding pass 410 and issued to the traveler. In accordance with one embodiment of the present invention, a frequent flyer smart card 400 and a smart card boarding pass 410, as shown in FIG. 6, contain at a minimum, the traveler's: last name 405, first name 410, middle initial 415, gender 420, address 425, phone number 430, preferences 435, form of the source identification (used to verify traveler's ID) 440, identification number 445 (from the source identification document), fingerprint biometric 450, next of kin 455, and checked baggage bar codes 460. FIG. 6 also shows that in addition to the information stored on frequent flyer smart card 400 and smart card boarding pass 410, databases 50 and 60 may store a facial recognition biometric 465, flight number 470, seat assignment 475 and timestamps 480.

Figure 7:
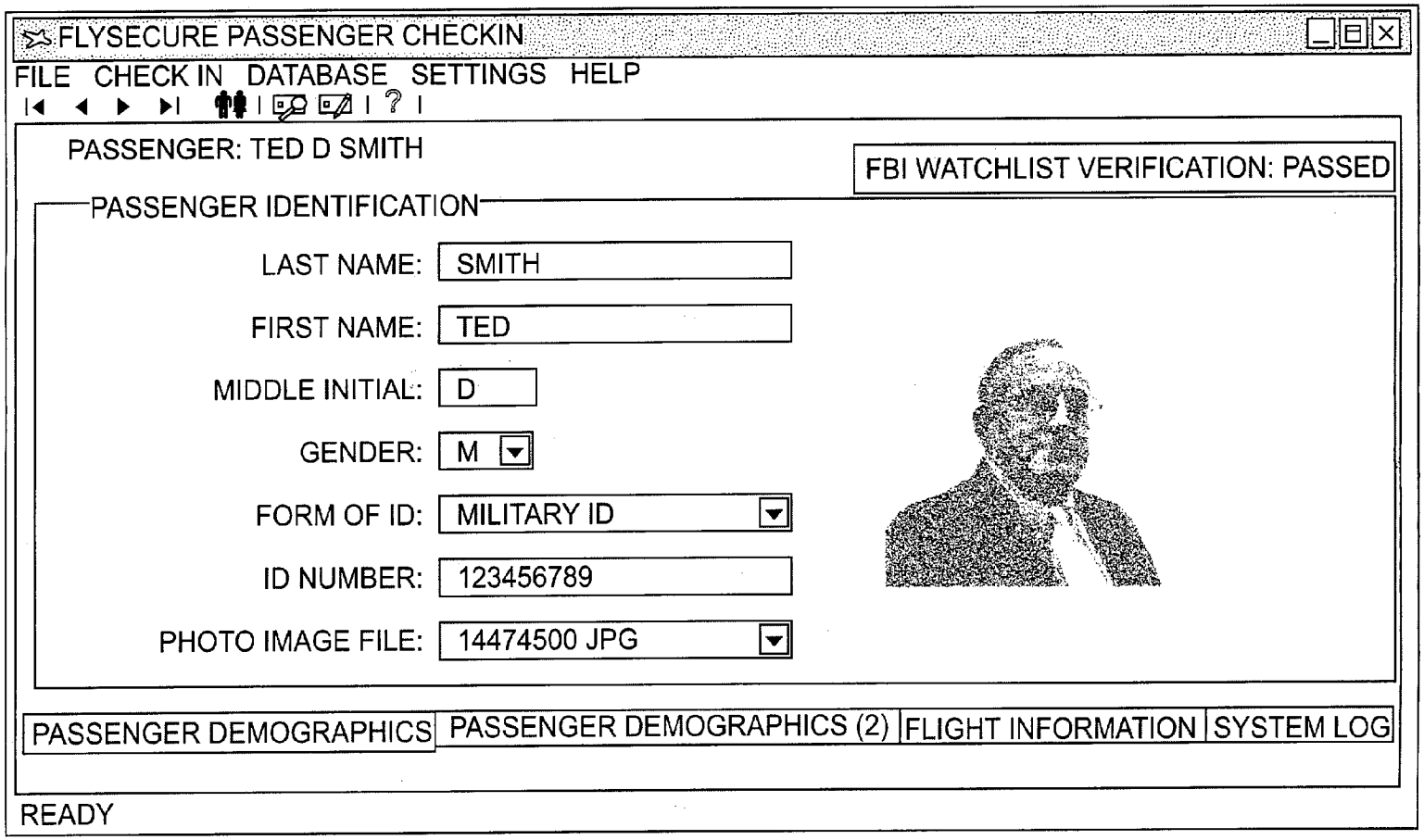
FIG. 7 is diagrammatic depiction of a display that may be shown to a check-in agent after the passenger data has been input into the present system.

Once the text and biometric information has been collected, processing flows to step 350 and a photographic image of the traveler is captured using image capture device 24. Referring to FIG. 7, there is shown a depiction of a screen that may be displayed on workstation 10 after a check-in agent has entered the information provided by the traveler and an image of the traveler has been captured. Once the photographic image is captured, processing flows to step 360 and the captured fingerprint and photographic image are sent to an external agency for further processing. At the completion of the boarding process, the traveler will be in possession of either a frequent flyer smart card 400 or a smart card boarding pass 410.

In one embodiment, smart card 400 or boarding pass 410 may be used by the traveler to gain access to other locations inside of the airport. For example, if the traveler would like to enter a frequent flyer courtesy lounge in the airport, they may simply place their frequent flyer smart card 400 into a smart card reader 26 located at the entrance of the courtesy lounge. Processor 12 coupled to the reader may then determine whether the traveler is authorized entrance to the lounge prior to granting access to the lounge.

In a second embodiment, a user may be required to input his/her smart card into smart card reader/writer 26 as well as have one or more of the user's immutable characteristics (fingerprint, image, etc.) recorded. For example, the traveler may have his picture taken by image capture device 24 and the input passed to processor 12. Further, a fingerprint of the traveler may be taken by biometric capture device 22 and the data passed to processor 12. Data read from frequent flyer smart card 400 or a smart card boarding pass 410 is then passed to processor 12 and a comparison performed. Processor 12 may, for example, compare the set of data obtained from frequent flyer smart card 400 or a smart card boarding pass 410 with the information obtained from one or more of the biometric/image capture devices 22 and 24. The result of this comparison is the decision whether the traveler is physically the same individual as that described on frequent flyer smart card 400 or smart card boarding pass 410. If the comparison is positive, processor 12 indicates this to an access control interface (not shown), which then would open a door or a gate, for example. A local or remote processor may also monitor the traveler's location while in the airport for security purposes. In one embodiment, a traveler may be identified as wanted or a person-of-interest by an external agency (FBI, CIA, etc.). In the present system, the traveler's movements throughout the airport may be monitored without raising the suspicions of the traveler. When the proper authorities are available, the wanted traveler may be located and apprehended without incident.

In cases where the validation site inherently requires a human operator (example, entrance into a controlled area), the complexity of the validation segment can be further reduced by eliminating the computerized comparison. In this example, when the traveler places his/her frequent flyer smart card 400 or smart card boarding pass 410 into smart card reader/writer 26, the stored facial feature corresponding to the inputted card is retrieved from storage 50 or 60 and displayed to the human operator via display 34. The human operator determines if the traveler's features match those decrypted from the medium presented by the traveler. The attribute and privilege data (in this example, access to the requested area) is also displayed to the operator via display 34, and is used to make a decision whether to allow the traveler to enter.

In a slightly more complex system, if a personal identification number were encrypted upon the frequent flyer smart card 400 or smart card boarding pass 410, the traveler would also have to enter a PIN number via keyboard 18 or keypad (not shown). The system would then compare these to numbers digitally and provide a further security check upon the status of user. It can be seen from the above that the verification portion of the system is very flexible. Such flexibility may provide great cost savings to some systems and allow a very high level of security for other systems.

As can be seen from the above description, the verification process may operate autonomously from the authorization site. That is, for each traveler presenting himself to the verification site, a message is not sent to the centralized data base of the authorization site. Further, a message need not be sent back to the verification site from the remote processing/storage site. In other words, data storage devices 50 and 60 need not be on-line twenty-four hours per day. Its functions need not be on-line at all with respect to the remote workstations (i.e., verification sites). Each traveler carries with him or her the frequent flyer smart card 400 or smart card boarding pass 410 which has been prepared cryptographically by an authorization site. This allows verification sites to operate autonomously and not require connection with a large centralized data base.

The verification process may alternatively be performed by processor 12. That is, processor 12 may compare the traveler's fingerprint as inputted at biometric capture device 22 with the data stored on his/her frequent flyer smart card 400 or smart card boarding pass 410 to ensure that the traveler is the same person as identified on the frequent flyer smart card or boarding pass. Processor 12 may then determine whether the identified traveler is permitted to board the particular flight. If both comparisons are favorable, a positive indication may be displayed on display device 34.

In one exemplary embodiment, the data may be sent to a national criminal investigation database, the Federal Bureau of Investigations (FBI), the Central Intelligence Agency (CIA), or other criminal investigation service. The recipient federal agency may then search its databases to determine whether the traveler is a fugitive from justice or other person-of-interest. Based on the collected information, the present system may make a determination that the traveler does have a confirmed reservation on the flight and that the traveler is not listed on any criminal watch list. As shown in FIG. 7, processing at the external agency, in this case the FBI, may be completed and the results reported to the check-in agent. If the traveler is wanted by the authorities, the present system may return a message to a workstation in airport security that informs airport security personnel of the identification and location of the wanted individual. The present system may also issue a smart card boarding pass 410 (or other boarding authorization) to the wanted passenger, thereby allowing him/her to pass through airport security, ostensibly in preparation to board the aircraft. In reality, the wanted passenger would approach airport security, place his/her smart card frequent flyer card 400 or smart card boarding pass 410 in a card reader 26 adjacent to a passenger inspection area. Airport security personnel may then be alerted as to the passenger's status, prior to inspecting the wanted passenger at the routine inspection areas. Once it is determined that the traveler does not have a weapon, he/she may then be uneventfully apprehended by security personnel.

Figure 8:
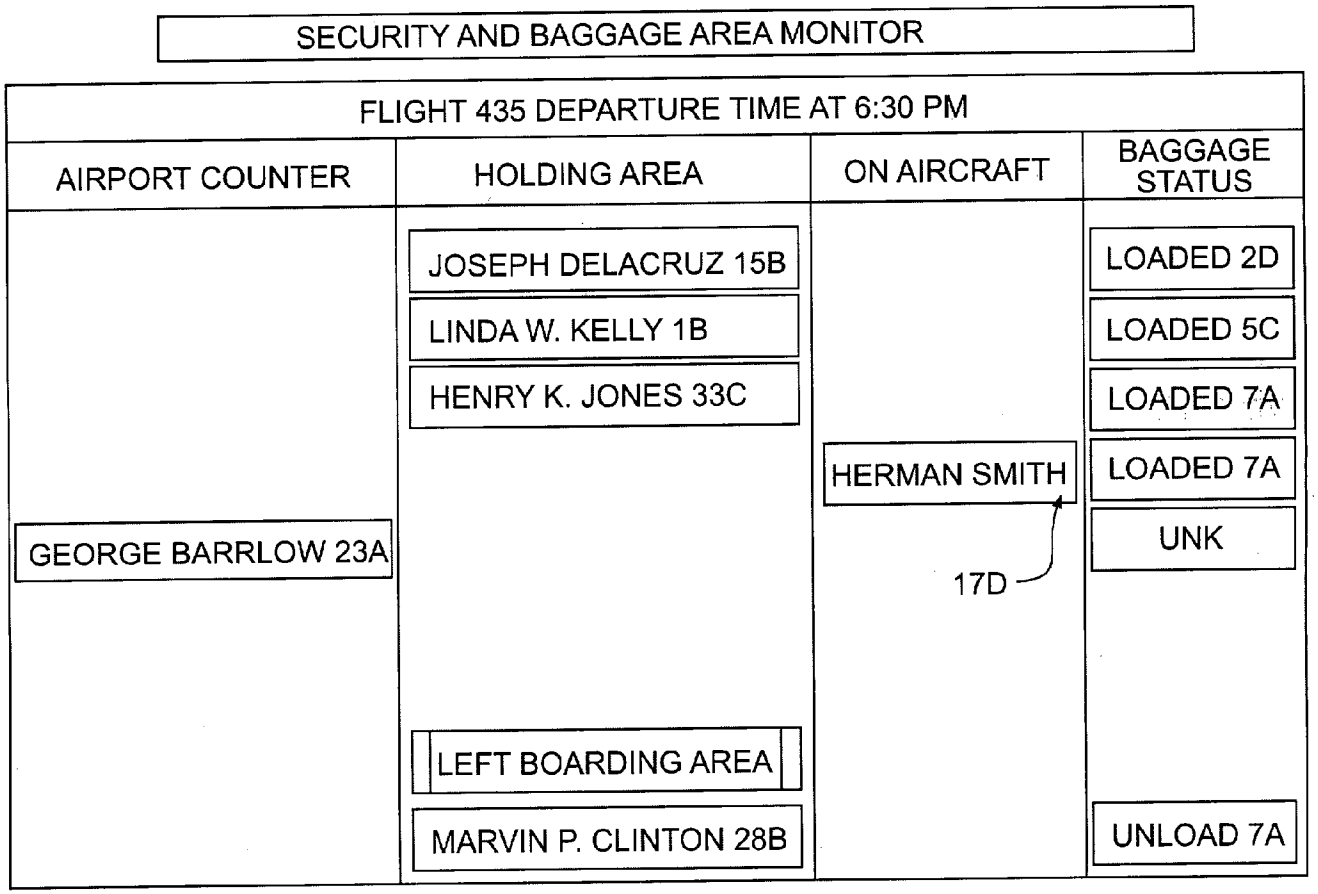
FIG. 8 is diagrammatic depiction of a display that may be shown to security personnel in accordance with one embodiment of the present invention.

In a second embodiment, security personnel located at authorized workstations 10 may enter a flight number into workstation 10 and instantaneously receive information on all passengers in the airport who have either checked in or who are in the process of checking in. Referring to FIG. 8, there is shown a representative display that may be depicted on a security workstation 10. As shown the status of passengers at the airport check-in counter, in a holding area, and on the aircraft may be displayed in a single screen. Also, the status of the passenger's luggage may also be displayed. Therefore, passengers that are either absent from the airport or the holding area may be quickly identified and addressed without delaying the scheduled departure of the selected flight.

Figure 9:
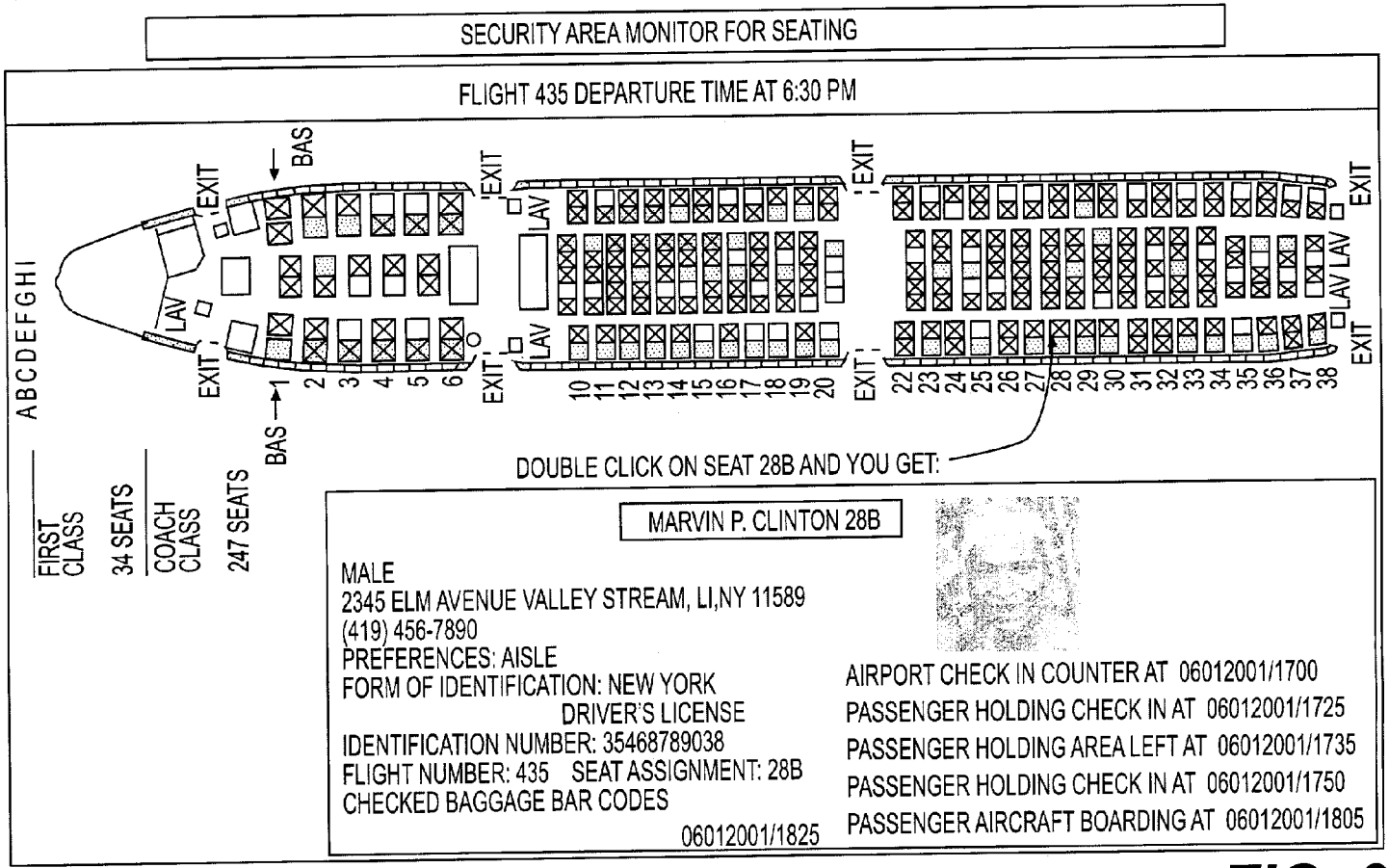
FIG. 9 is diagrammatic depiction of a display that may be shown to a boarding agent in accordance with one embodiment of the present invention.
Figure 10:
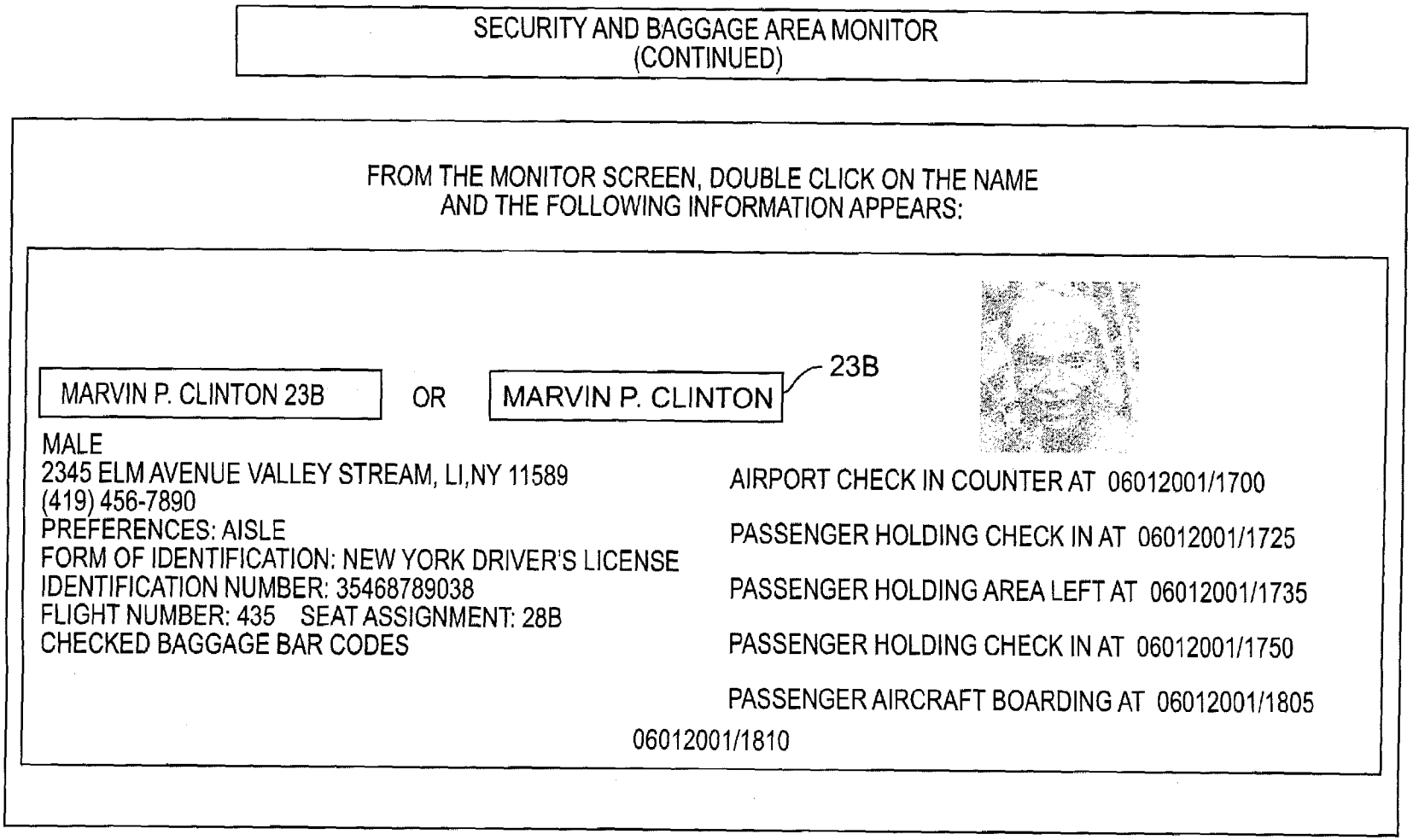
FIG. 10 diagrammatic depiction of a second display that may be shown to a boarding agent in accordance with one embodiment of the present invention.

The process for boarding an airplane is similar to that used by the traveler to gain access to other locations inside of the airport. In other words, when the traveler places his/her frequent flyer smart card 400 or smart card boarding pass 410 into smart card reader/writer 26 at the boarding gate, the stored facial feature corresponding to the inputted card may be retrieved from storage 50 or 60 and displayed to the human operator located at the boarding gate via display 34. The human operator determines if the traveler's features match those received from the medium presented by the traveler. The attribute and privilege data (in this example, access to the plane including assigned seat) is also displayed to the operator via display 34, and is used to make a decision whether to allow the traveler to board. Referring to FIG. 9, there is shown a typical display that may be displayed to a boarding agent located in the boarding area. As shown, FIG. 9 depicts a passenger seating compartment of a plane scheduled to depart shortly. An "X" is displayed at an occupied seat and unoccupied seats are blank. When a boarding agent uses mouse 20 or other pointing device to select an occupied seat, a display similar to FIG. 10, may be displayed on the screen. In that way, a passenger's movements from the time he/she enters the airport until the passenger boards the aircraft can be collected and stored for future use.

If a traveler has checked-in, but not boarded an airplane scheduled to depart, the present system may use its ability to track the location of travelers in the terminal and then send a message to a workstation located in the immediate area to notify the traveler of the pending departure. The present system may alternatively be used to initiate the transmission of a message over the public address system in the immediate area to notify the traveler of the imminent departure of their requested flight. In the event the traveler has left the airport, or does not otherwise respond to the page, the present system may then identify the traveler's checked luggage, if any, and then initiate action to have the luggage removed from the airplane. The present system may also initiate a message to airport security or other authorized personnel of the situation.

Once the traveler has boarded the aircraft and the aircraft has begun the trip to the planned destination, the final traveler manifest may be transmitted to the National Transportation Safety Board (NTSB) for tracking purposes.

When the flight reaches its destination, frequent flyer smart card 400 and smart card boarding pass 410 may be used to verify ownership of checked baggage. More specifically, a baggage claim checker carrying a handheld device may read frequent flyer smart card 400 and smart card boarding pass 410, compare the bar codes retrieved from the smart card with the bar code affixed to one or more pieces of retrieved luggage to ensure ownership of the luggage by the passenger.

Although the preferred embodiment of the invention has been illustrated, and that form described in detail, it will be readily apparent to those skilled in the art that various modifications may be made therein without departing from the spirit of the invention or from the scope of the appended claims. From the foregoing description, it will be appreciated that the present invention provides an efficient system and method for creating and decoding documents containing machine-readable text overlaid with human-readable text. The present invention has been described in relation to particular embodiments which are intended in all respects to be illustrative rather than restrictive. Those skilled in the art will appreciate that many different combinations of hardware will be suitable for practicing the present invention. Many commercially available substitutes, each having somewhat different cost and performance characteristics, exist for each of the components described above.

Although aspects of the present invention are described as being stored in memory, one skilled in the art will appreciate that these aspects can also be stored on or read from other types of computer-readable media, such as secondary storage devices, like hard disks, floppy disks, or CD-ROMs; a carrier wave from the Internet; or other forms of RAM or ROM. Similarly, the method of the present invention may conveniently be implemented in program modules that are based upon the flow charts in FIG. 3. No particular programming language has been indicated for carrying out the various procedures described above because it is considered that the operations, steps and procedures described above and illustrated in the accompanying drawings are sufficiently disclosed to permit one of ordinary skill in the art to practice the instant invention. Moreover, there are many computers and operating systems which may be used in practicing the instant invention and, therefore, no detailed computer program could be provided which would be applicable to these many different systems. Each user of a particular computer will be aware of the language and tools which are most useful for that user's needs and purposes.

Alternative embodiments will become apparent to those skilled in the art to which the present invention pertains without departing from its spirit and scope. Accordingly, the scope of the present invention is defined by the appended claims rather than the foregoing description.

What is claimed is:

1. A method for providing passenger accountability, comprising:

receiving information identifying a passenger seeking to board a commercial carrier;

authenticating the passenger by comparing the identifying information to stored information;

issuing a card to the passenger when the passenger has been authenticated, the card including a processor and an identity check tool;

using the identity check tool on the card to verify the passenger at a plurality of verification sites prior to a boarding checkpoint;

storing time and location data corresponding to each time the identity check tool is used to verify the passenger;

using the stored time and location data to determine a current location of the passenger based on a most recent time the identity check tool was used to verify the passenger; and displaying the current location of the passenger determined using the stored time and location data.

2. The method of claim 1, further comprising:

identifying a verified passenger that has not boarded the commercial carrier by a predetermined time from departure; and removing checked baggage associated with the verified passenger that has not boarded.

3. The method of claim 1, wherein authenticating further comprises using the identifying information to identify passenger records stored on an external database that correspond to passengers that may pose a security threat.

4. The method of claim 1, wherein using the identity check tool further comprises receiving biometric information from the passenger.

5. The method of claim 1, further comprising:

storing boarding information for the passenger on the card; and enabling the passenger to use the card to board multiple commercial carriers.

6. The method of claim 1, wherein receiving further comprises:

receiving biometric information from the passenger; and wherein using the identity check tool further comprises comparing the biometric information received with biometric information provided by the passenger using the identity check tool.

7. The method of claim 6, further comprising:

receiving a photographic image of the passenger; and transmitting identifying information, biometric information and the photographic image of the passenger to an external database.

8. The method of claim 7, further comprising receiving a notice that the passenger is wanted by a law enforcement agency.

9. The method of claim 1, further comprising:

storing location data on the card when the passenger is verified using the identity check tool.

10. The method of claim 9, wherein the location data is stored using technology in compliance with ISO 7816 specifications.

11. The method of claim 9, wherein the location data is stored using technology in compliance with ISO 14443 specifications.

12. A method for providing passenger accountability, comprising:

receiving information identifying a passenger seeking to board a commercial carrier;

authenticating the passenger by comparing the identifying information to stored information;

issuing a card to the passenger only when the passenger has been authenticated, the card including a processor and an identity check tool; and using the identity check tool to confirm the passenger's identity at a plurality of checkpoints in an airport prior to a boarding checkpoint;

storing time and location data each time the identity check tool is used to confirm the passenger's identity;

using the stored time and location data to determine a current location of the passenger based on a most recent time the identity check tool was used to verify the passenger; and displaying the current location of the passenger together with the stored time and location data.

13. The method of claim 12, further comprising authenticating the passenger using an external database.

14. The method of claim 12 wherein the identity check tool includes:

identifying information for the passenger.

15. The method of claim 14, wherein the identifying information is compared to information provided by the passenger at the plurality of checkpoints.

16. The method of claim 12, further comprising:

storing location information on the card each time the passenger's identity is confirmed at one of the checkpoints.

17. An apparatus for facilitating passenger accountability, comprising:

a credit-card size device including a memory adapted to store electronic information and a processor, wherein said information comprises:

information identifying a plurality of times and locations that a passenger's identity is verified in a mass transit facility after the passenger has left an initial passenger check-in location; and information identifying a time that the passenger boards a commercial carrier, and wherein said processor uses the information identifying the plurality of times and locations that the passenger's identity is verified to determine a current location of the passenger.

18. The apparatus of claim 17, wherein the processor verifies the passenger's identity and determines each of the plurality of times and locations using a locator technology at a plurality of checkpoints in the mass transit facility.

19. The apparatus of claim 18, wherein the locator technology complies with ISO 7816 specifications.

20. The apparatus of claim 18, wherein the locator technology complies with ISO 14443 specifications.

* * * * *